US009236002B2

(12) United States Patent
Lee et al.

(10) Patent No.: US 9,236,002 B2
(45) Date of Patent: Jan. 12, 2016

(54) STEREOSCOPIC IMAGE DISPLAY AND DRIVING METHOD THEREOF

(71) Applicant: LG DISPLAY CO., LTD., Seoul (KR)

(72) Inventors: Changho Lee, Paju-si (KR); Joonyoung Park, Paju-si (KR); Juseong Park, Goyang-si (KR); Jeongki Lee, Paju-si (KR); Jeongki Kim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 59 days.

(21) Appl. No.: 14/137,310

(22) Filed: Dec. 20, 2013

(65) Prior Publication Data

US 2014/0375621 A1 Dec. 25, 2014

(30) Foreign Application Priority Data

Jun. 25, 2013 (KR) ..... 10-2013-0072925

(51) Int. Cl.

*G09G 3/20* (2006.01)
*G09G 3/00* (2006.01)
*G09G 3/36* (2006.01)

(52) U.S. Cl.

CPC ..... *G09G 3/003* (2013.01); *G09G 3/3614* (2013.01); *G09G 3/3648* (2013.01); *G09G 2320/0209* (2013.01); *G09G 2340/16* (2013.01)

(58) Field of Classification Search

CPC ..... G09G 2320/0209; G09G 2340/16; G09G 3/003; G09G 3/3614; G09G 3/3648

USPC ..... 345/87, 212, 58, 419, 694

See application file for complete search history.

(56) References Cited

U.S. PATENT DOCUMENTS

| | | | | |
|---|---|---|---|---|
| 2010/0309175 | A1 | 12/2010 | Ohtsuki | |
| 2012/0126720 | A1* | 5/2012 | Kim et al. | 315/307 |
| 2012/0206441 | A1* | 8/2012 | Liu et al. | 345/419 |
| 2013/0002653 | A1 | 1/2013 | Lee et al. | |
| 2013/0009941 | A1 | 1/2013 | Hwang et al. | |
| 2013/0088654 | A1 | 4/2013 | Kim et al. | |
| 2013/0229326 | A1* | 9/2013 | Kamada | 345/32 |
| 2013/0257827 | A1* | 10/2013 | Hsieh et al. | 345/204 |

FOREIGN PATENT DOCUMENTS

| | | | |
|---|---|---|---|
| JP | 2010-281957 | A | 12/2010 |
| JP | 2013-11859 | A | 1/2013 |
| JP | 2013-20253 | A | 1/2013 |
| WO | WO 2012-063830 | A1 | 5/2012 |

* cited by examiner

*Primary Examiner* — Viet Pham

(74) *Attorney, Agent, or Firm* — Birch, Stewart, Kolasch & Birch, LLP

(57) ABSTRACT

A stereoscopic image display and a driving method thereof are discussed. The stereoscopic image display includes a data driving circuit that supplies a data voltage to data lines of a display panel; a gate driving circuit that supplies a gate pulse to gate lines of the display panel; and a timing controller that controls operation timings of the data driving circuit and gate driving circuit. The gate driving circuit delays a rising timing of the gate pulse to a point in time after a rising edge time of the data voltage in a 3D mode for displaying a 3D image on the display panel, under a control of the timing controller.

19 Claims, 12 Drawing Sheets

STEREOSCOPIC IMAGE DISPLAY AND DRIVING METHOD THEREOF

This application claims the priority benefit of Korean Patent Application No. 10-2013-0072925 filed on Jun. 25, 2013, which is incorporated herein by reference for all purposes as if fully set forth herein.

BACKGROUND OF THE INVENTION

1. Field of the Invention

Embodiments of the invention relate to a stereoscopic image display and a driving method thereof.

2. Description of the Related Art

Stereoscopic image displays are categorized into a glasses type that requires the use of special glasses and a non-glasses type that does not require use of the special glasses. In the glasses type, a binocular parallax image is displayed on a direct view-based display device or a projector by changing a polarization direction or in a time division manner, and polarization glasses or liquid crystal shutter glasses are used to implement stereoscopic images. In the non-glasses type, generally, an optical plate such as a parallax barrier or the like for separating an optical axis of the binocular parallax image is provided in front of a display screen so that left-eye image light and right-eye image light are separated to implement stereoscopic images.

Glasses-type stereoscopic image displays are categorized into a polarization glasses type and a shutter glasses type. The polarization glasses type requires a polarization separation device, such as a patterned retarder, to be bonded to a display panel. The patterned retarder separates the polarizations of a left-eye image and a right-eye image displayed on the display panel, thereby creating a binocular parallax. As the polarizations of the left-eye image and the right-eye image are separated by the patterned retarder, a viewer wearing polarization glasses can see the left-eye image with the left eye and the right-eye image with the right eye and therefore can perceive a stereoscopic effect due to the binocular parallax. The patterned retarder may be implemented as a glass patterned retarder GPR based on a glass substrate or a film patterned retarder FPR based on a film substrate. In recent years, the film patterned retarder FPR, which can reduce the thickness, weight, price, etc., of the display panel compared to the glass patterned retarder GPR, has come to be more preferred.

If a stereoscopic image display that displays a stereoscopic image by the binocular parallax is unable to completely separate the left-eye image and the right-eye image, the viewer may feel or perceive a crosstalk where the left-eye image and the right-eye image overlap each other when viewing them with a single eye (left eye or right eye). A gray-to-gray (GTG) crosstalk is defined as a mean crosstalk for the gray levels.

On the screen (or pixel array) of the polarization glasses type stereoscopic image display, odd-numbered pixel lines (hereinafter, abbreviated as "odd lines" can display a left-eye image and even-numbered pixel lines (hereinafter, abbreviated as "even lines") can display a right-eye image. In this polarization glasses type stereoscopic image display, gray-to-gray (GTG) crosstalk may be represented as a mean value of a perceived crosstalk for the gray levels of odd and even lines on the screen. In the polarization glasses type stereoscopic image display, there is as big a difference in gray level between data written to the pixels of odd lines and data written to the pixels of even lines, both of which are connected to the same data line, as the binocular disparity between the left-eye image and the right-eye image. Thus, the polarization glasses type stereoscopic image display is more susceptible to gray-to-gray crosstalk. In other words, the polarization glasses type stereoscopic image display shows a large difference in gray level between data voltages continuously supplied to the pixels of odd lines and the pixels of even lines, respectively, through the same data line.

SUMMARY OF THE INVENTION

Embodiments of the invention have been made in an effort to provide a stereoscopic image display which can reduce crosstalk in a stereoscopic image and a driving method thereof.

A stereoscopic image display according to an embodiment of the invention includes: a data driving circuit that supplies a data voltage to data lines of a display panel; a gate driving circuit that supplies a gate pulse to gate lines of the display panel; and a timing controller that controls operation timings of the data driving circuit and gate driving circuit. The gate driving circuit delays a rising timing of the gate pulse to a point in time after a rising edge time of the data voltage in a 3D mode for displaying a 3D image on the display panel, under the control of the timing controller.

A driving method of a stereoscopic image display according to an embodiment of the invention includes: supplying a data voltage to data lines of a display panel; and supplying a gate pulse to gate lines of the display panel. A rising timing of the gate pulse is delayed to a point in time after a rising edge time of the data voltage in a 3D mode for displaying a 3D image on the display panel.

A driving method of a stereoscopic image display according to an embodiment includes supplying a data voltage to data lines of a display panel; and supplying a gate pulse to gate lines of the display panel at different times depending on selection of a 2D mode for displaying a 2D image on the display panel or a 3D mode for displaying a 3D image on the display panel.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Figure 1:
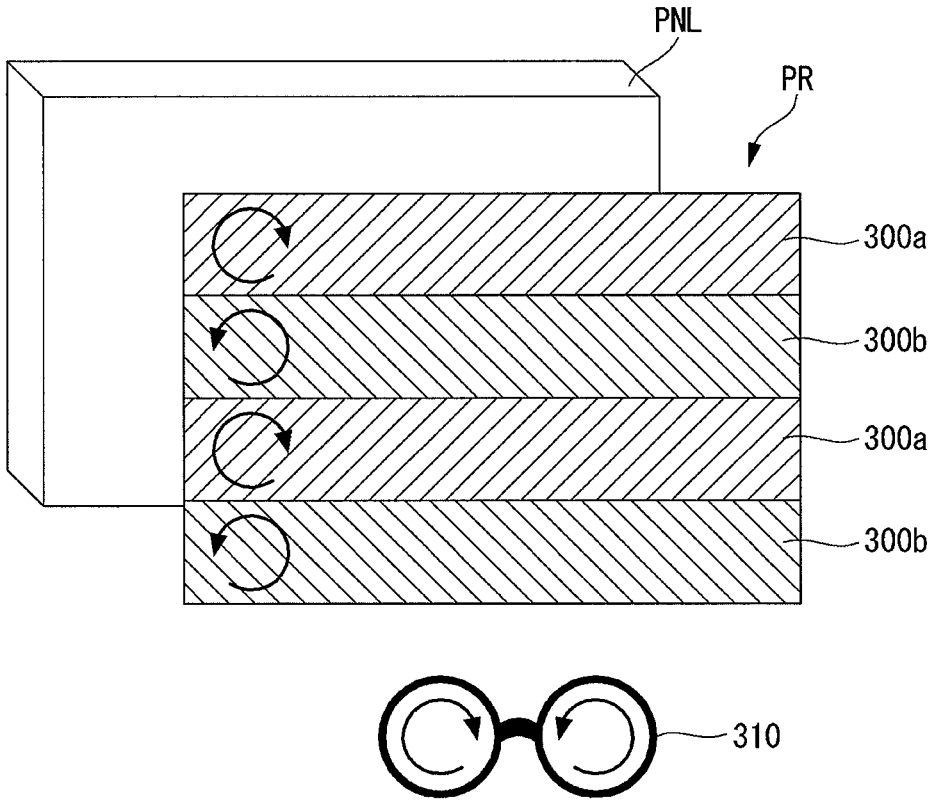
FIG. 1 is a view schematically showing a stereoscopic image display according an example embodiment of the invention.

Hereinafter, example embodiments of the invention will be described in detail with reference to the attached drawings. Throughout the specification, the same reference numerals indicate substantially the same components. Further, in the following description, well-known functions or constructions related to the embodiments of the invention will not be described in detail if it appears that they could obscure the embodiments of the invention in unnecessary detail.

The stereoscopic image display of the embodiment of the invention may be implemented based on a liquid crystal display. The liquid crystal display may be implemented in any form including a transmissive liquid crystal display, a transflective liquid crystal display, and a reflective liquid crystal display. The transmissive liquid crystal display and the transflective liquid crystal display require a backlight unit. The backlight unit may be implemented as a direct type backlight unit or an edge type backlight unit.

Figure 2:
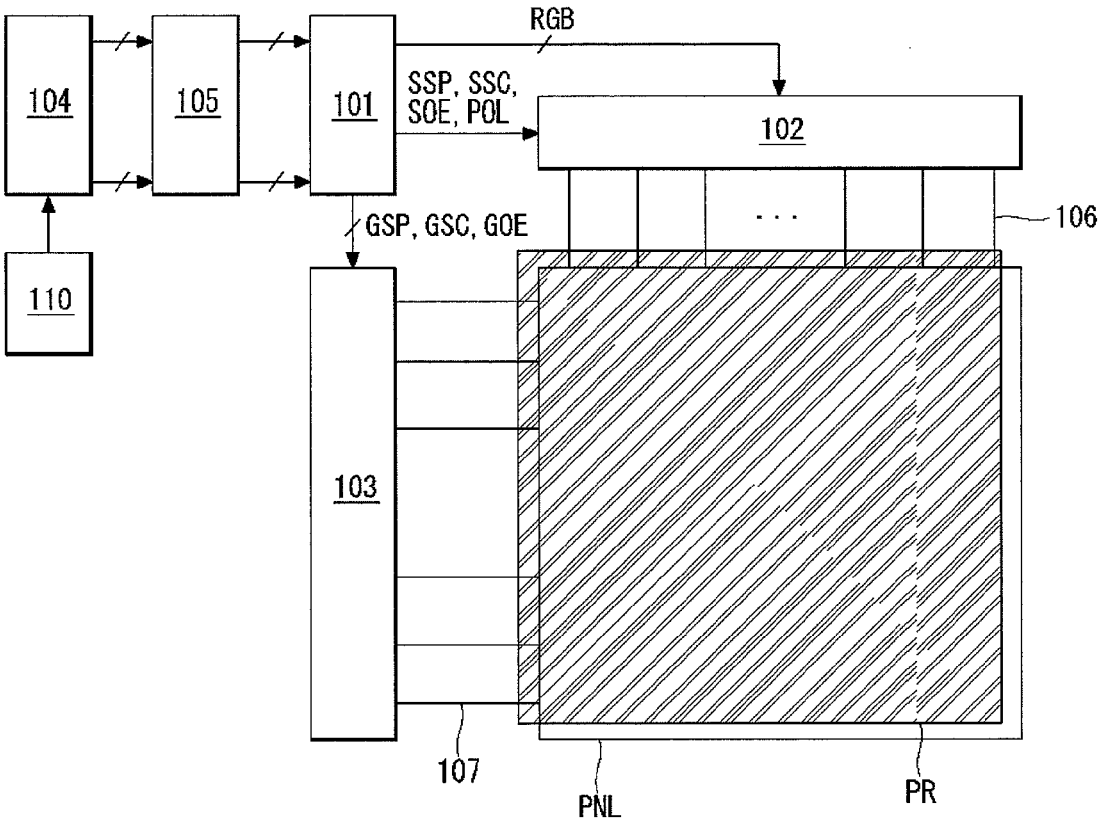
FIG. 2 is a block diagram showing driving circuits of the stereoscopic image display shown in FIG. 1.

Referring to FIGS. 1 and 2, the stereoscopic image display according to an example embodiment of the invention includes a liquid crystal display panel PNL, a patterned retarder PR. Polarization glasses 310 may be used to view a stereoscopic image of the stereoscopic image display.

The display panel PNL may be implemented as a display panel of a liquid crystal display (LCD), but is not limited thereto. The display panel PNL comprises a pixel array in which data lines and gate lines cross each other and pixels are arranged in a matrix to display 2D/3D images. The display panel PNL may be implemented as a display panel for a flat panel display, such as a liquid crystal display (LCD) or an organic light emitting diode (OLED) display, that applies a data voltage and a gate pulse (or scan pulse) to the pixels.

On a lower substrate of the display panel PNL of the liquid crystal display (LCD), formed are data lines 106, gate lines 107 crossing the data lines 106, TFTs (thin film transistors; T of FIG. 13) formed at the crossings of the data lines 106 and the gate lines 107, pixel electrodes and a common electrode of liquid crystal cells (Clc of FIG. 13) connected to the TFTs T, and storage capacitors (Cst of FIG. 13) connected to the liquid crystal cells Clc. On an upper substrate of the liquid crystal display panel PNL, a black matrix, color filters, etc., are formed. Polarization plates are formed respectively on the lower and upper substrates of the liquid crystal display panel PNL. In the lower and upper substrates, alignment layers for setting a pre-tilt angle of liquid crystals are respectively formed on the surfaces contacting the liquid crystals. A column spacer for keeping a cell gap of the liquid crystal layer may be formed between the lower substrate and the upper substrate.

The patterned retarder PR is attached onto the display panel PNL. The patterned retarder PR comprises a first phase delay pattern 300*a* facing odd-numbered lines in the screen (or pixel array) of the liquid crystal display panel PNL and a second phase delay pattern 300*b* facing even-numbered lines in the screen (or pixel array). Optical axes of the first phase delay pattern 300*a* and the second phase delay pattern 300*b* are orthogonal to each other. The first phase delay pattern 300*a* and the second phase delay pattern 300*b* each may be implemented as a birefringent medium that delays the phase of incident light by ¼ wavelength. The pattern retarder PR may be implemented as a film patterned retarder FPR based on a film substrate.

On the display panel PNL, the odd-numbered lines may display a left-eye image, and the even-numbered lines may display a right-eye image. In this instance, light of the right-eye image displayed in the odd-numbered lines of the pixel array passes through the upper polarization plate and enters the first phase delay pattern 300*a* of the patterned retarder PR. Light of the left-eye image displayed in the even-numbered lines of the pixel array passes through the upper polarization plate and enters the second phase delay pattern 300*b*. Light of the left-eye image and light of the right-eye image are linearly polarized along the same polarization direction while passing through the upper polarization plate and enter the patterned retarder PR. Linearly polarized light of the left-eye image that enters the first phase delay pattern 300*a* of the patterned retarder PR through the upper polarization plate is phase-delayed by a phase difference of the first phase delay pattern 300*a*, passes through the first phase delay pattern 300*a*, and is then converted into first polarized light. Linearly polarized light of the right-eye image that enters the second phase delay pattern 300*b* of the patterned retarder PR through the upper polarization plate is phase-delayed by a phase difference of the second phase delay pattern 300*b*, passes through the second phase delay pattern 300*b*, and is then converted into second polarized light. The first polarized light and the second polarized light are illustrated as being left circularly polarized light and right circularly polarized light, but the embodiments of the invention are not limited thereto. The polarization characteristics of the first polarized light and the second polarized light may vary depending on the phase delay values and polarization direction of the phase delay patterns 300*a* and 300*b* of the patterned retarder PR.

A left-eye polarization filter of the polarization glasses 310 allows only the first polarized light to pass therethrough, and a right-eye polarization filter thereof allows only the second polarized light to pass therethrough. Accordingly, when a viewer wears the polarization glasses 310 in the 3D mode, the viewer sees pixels displaying the left-eye image with the left eye and pixels displaying the right-eye image with the right eye, thereby having a stereoscopic feeling (or perceiving a stereoscopic image) due to a binocular parallax.

The stereoscopic image display of the embodiment of the invention comprises a display panel driving circuit. The display panel driving circuit writes 2D image data in the pixels of the display panel PNL in the 2D mode and writes 3D image (or stereoscopic image) data in the pixels of the display panel PNL in the 3D mode. As shown in FIG. 2, the display panel driving circuit comprises a data driver 102, a gate driver 103, a data formatter 105, and a timing controller 101.

The data driver 102 latches digital video data RGB of 2D/3D images under the control of the timing controller 101. The data driver 102 converts the digital video data RGB into a gamma compensation voltage to generate a data voltage. In the 2D mode, the data driver 102 outputs the data voltage of a 2D image, which is not divided into a left-eye image and a right-eye image, that is, has no binocular parallax. In the 3D mode, the data driver 102 supplies the data voltage of the left-eye image and the data voltage (Vdata of selective FIGS. 3 through 8) of the right-eye image to the data lines 106.

The gate driver 103 sequentially supplies a gate pulse (or scan pulse) to the gate lines 107 under the control of the timing controller 101. The gate pulse (Vgate of selective FIGS. 3 through 14) swings between a gate low voltage VGL and a gate high voltage VGH.

The data formatter 105 receives 3D image data input from a host system 104 in the 3D mode, and separates left-eye image data and right-eye image data line by line and transmits them to the timing controller 101. Also, the data formatter 105 converts 2D image data input from a host system 104 in the 3D mode by using a 2D-3D image conversion algorithm, and separates left-eye image data and right-eye image data line by line and transmits them to the timing controller 101. In the 2D mode, the data formatter 105 transmits 2D image data input from the host system 104 as is to the timing controller 101.

Upon receiving timing signals such as a vertical synchronization signal Vsync, a horizontal synchronization signal Hsync, a data enable signal DE, a dot clock CLK, etc., from the host system 104, the timing controller 101 generates timing control signals for controlling operation timings of the data driver 102, the gate driver 103, and a 3D controller 112.

The timing control signals comprise a gate timing control signal for controlling an operation timing of the gate driver 103 and a data timing control signal for controlling an operation timing of the data driver 102 and the polarity of a data voltage. Also, the timing control signals comprise a 3D timing control signal for controlling an operation timing of the 3D controller 112.

The gate timing control signal comprises a gate start pulse (GSP), a gate shift clock (GSC), a gate output enable signal (GOE), and the like. The gate start pulse (GSP) controls a start operation timing of the gate driver 103. The gate shift clock (GSC) is a clock signal for shifting the gate start pulse (GSP). The gate output enable signal (GOE) controls an output timing of the gate driver 103. The gate timing control signal is generated in the 2D mode and the 3D mode.

The data timing control signal comprises a source start pulse SSP, a source sampling clock SSC, a polarity control signal POL, a source output enable signal SOE, and the like. The source start pulse SSP controls a data sampling start timing of the data driver 102. The source sampling clock SSC is a clock signal for controlling a shift timing of the source start pulse SSP. The polarity control signal POL controls a polarity inversion timing of a data voltage output from the data driver 102. The source output enable signal SOE controls an output timing of the data driver 102. In the instance of an organic light emitting diode display, the polarity control signal POL may be omitted.

The timing controller 101 may control operation timings of the drivers 102 and 103 by a frame frequency of (input frame frequency×i) Hz (i is a positive integer), which is obtained by multiplying an input frame frequency i times. The input frame frequency is 60 Hz in NTSC (National Television Standards Committee) mode and 50 Hz in PAL (Phase-Alternating Line) mode.

The host system 104 may be implemented as any one of the following: a TV system, a navigation system, a set-top box, a DVD player, a bluray player, a personal computer (PC), a home theater system, a broadcast receiver, and a phone system. The host system 104 may supply a mode selection signal for indicating the 2D mode or the 3D mode to the timing controller 101. The host system 104 switches between a 2D mode operation and a 3D mode operation in response to user data input through a user input device 110. The host system 104 may identify the 2D mode operation and the 3D mode operation through a 2D or 3D identification code encoded to input image data, for example, a 2D or 3D identification code which can be coded in an EPG (electronic program guide) or an ESG (electronic service guide) of a digital broadcasting standard.

The user may select between the 2D mode and the 3D mode by a user input device 110. The user input device 110 may comprise a touch screen attached onto or included in the liquid crystal display panel PNL, an on-screen display (OSD), a keyboard, a mouse, and a remote controller.

Figure 3:
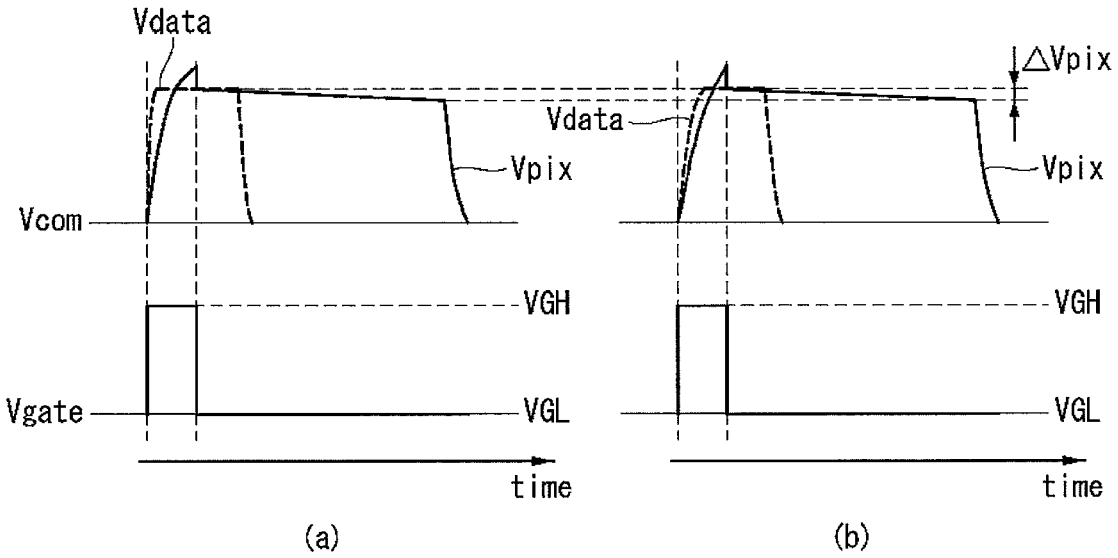
FIG. 3 is a waveform diagram showing an example in which a pixel voltage deviation occurs due to a difference in rising characteristics between data voltages.
Figure 4:
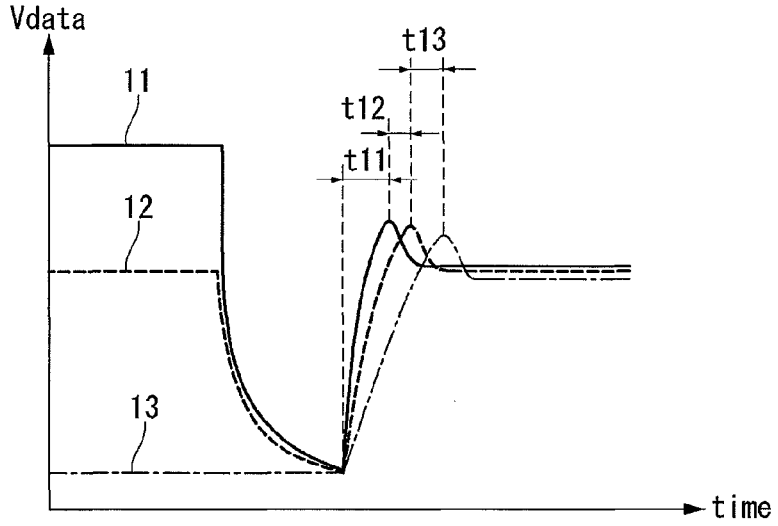
FIG. 4 is a view showing a difference in rising characteristics caused by a gray level difference in consecutive data.

In a gray-to-gray (GTG) crosstalk evaluation test for the stereoscopic image display of FIGS. 1 and 2, when the data voltage of the left-eye image and the data voltage of the right-eye image are alternately output from the data driving circuit 102, the rising characteristic of the data voltage of the later single-eye image (right-eye image or left-eye image) supplied to the data lines 106 varies with the gray level of the data voltage of the previous single-eye image (left-eye image or right-eye image). As seen in FIGS. 3 and 4, a difference in rising characteristic between data voltages gives rise to a deviation in the pixel voltage charged in the pixels at the same gray level, thus allowing the viewer to feel or perceive gray-to-gray (GTG) crosstalk. In FIGS. 3 and 4, Vdata is a data voltage applied to the data lines 106. Vpix is a pixel voltage charged in the pixel electrodes of the pixels. ΔVpix is a deviation in the pixel voltage. The data voltage Vdata may be applied to the pixel electrodes of the pixels through the data lines 106 and the TFTs. Vgate is the voltage of a gate pulse applied to the gate lines 107. Vcom is a common voltage applied to the common electrode. FIG. 3 especially depicts waveform diagrams showing two examples in which a pixel voltage deviation occurs due to a difference in rising characteristics between data voltages. In (a) of FIG. 3, the rising characteristic of the data voltage (Vdata) is relatively rapid, while in (b) of FIG. 3, the rising characteristic of the data voltage (Vdata) is relatively less rapid, as shown by their relative slopes.

FIG. 3(*a*) and FIG. 3(*b*) show that the data voltages supplied to the data lines have different rising characteristics depending on the gray level of the previous image data. The voltage supplied to the data lines in FIG. 3(*a*) rises faster than that in FIG. 3(*b*), and this affects the actual pixel charging rate and the actual amount of charge in the pixels.

FIG. 3(*a*) depicts an example in which the amount of charge in the pixels is large because the pixel voltage rises fast when the difference between the gray level of a single-eye image written to the pixels of an Nth (N is a positive integer) line and the gray level of the other single-eye image written to the pixels of an (N+1)th line. Here, the pixels of the Nth line and the pixels of the (N+1)th line are connected to the same data line and continuously charged with data voltages. FIG. 3(*b*) depicts an example in which the amount of charge in the pixels is small because the rising of the pixel voltage is delayed when the difference between the gray level of a single-eye image written to the pixels of the Nth (N is a positive integer) line and the gray level of the other single-eye image written to the pixels of the (N+1)th line is relatively large. For example, (a) indicates that the left-eye image data to be charged to the pixels of the Nth line through the same data line has a white gray level and the right-eye image data to be charged to the pixels of the (N+1)th line through the same data line also has a white gray level. On the contrary, (b) indicates that the left-eye image data to be charged to the pixels of the Nth line through the same data line has a black gray level and the right-eye image data to be charged to the pixels of the (N+1)th line through the same data line also has a white gray level.

In FIG. 4, the first waveform 11 is a data voltage waveform in which a second single-eye image data voltage of gray value 191 is supplied to the data lines 106 during a horizontal blanking period immediately after a first single-eye image data of gray value 255 is supplied to the data lines 106. The second waveform 12 is a data voltage waveform in which a second single-eye image data voltage of gray level 191 is supplied to the data lines 106 during a horizontal blanking period immediately after a first single-eye image data of gray level 191 is supplied to the data lines 106. The third waveform 13 is a data voltage waveform in which a second single-eye image data voltage of gray level 191 is supplied to the data lines 106 during a horizontal blanking period immediately after a first single-eye image data of gray level 0 is supplied to the data lines 106. Although the second single-eye image data voltages in the first through third waveforms 11, 12, and 13 have the same gray level 191, the rising edge times t11, t12, and t13 differ due to the effect of the gray level of the previous first single-eye image data voltage. This is because the voltage charged in the parasitic capacitance of the data lines 106 varies with the gray level of an N-th (N is a positive integer) data voltage, and because the rising edge time varies with the precharge voltage of the data lines 106 when the subsequent (N+1)-th data voltage is supplied.

For a 3D image, the left-eye image and the right-eye image are divided by binocular parallax, and this may increase the difference in gray level between neighboring pixels and increase the difference in rising characteristics between the neighboring pixels. In contrast, a 2D image is an image which is not divided into a left-eye image and a right-eye image, that is, has no binocular parallax, and therefore the pixel voltages charged in the neighboring pixels mostly have similar gray levels. Accordingly, a gray level difference in the 2D mode causes little difference in the rising characteristics between the pixel voltages charged in the neighboring pixels. In the 2D mode, any difference in the rising characteristics between pixel voltages is generated when consecutive data voltages have the same polarity or different polarities.

Figure 5:
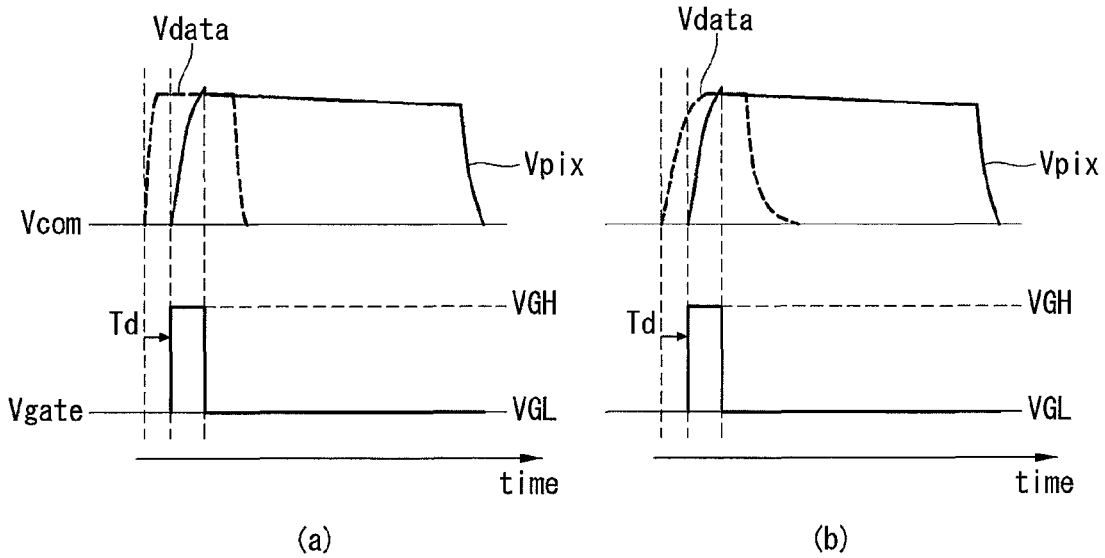
FIG. 5 is a waveform diagram showing a method of delaying a rising timing of a gate pulse according to an example embodiment of the invention.
Figure 6:
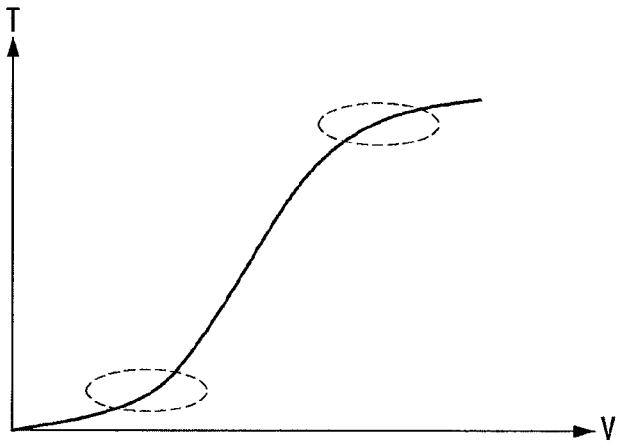
FIG. 6 is a view showing a gamma characteristic variance relative to a luminance difference based on a change in a pixel voltage.

The inventors have selectively delayed the rising timing at which a gate pulse rises in the 3D mode, as shown in FIGS. 5 and 6, in order to reduce gray-to-gray (GTG) crosstalk that the viewer feels or perceives under an actual viewing environment. As a result of delaying the gate pulse and testing the gate pulse using the stereoscopic image display of FIGS. 1 and 2, the effect of gray-to-gray (GTG) crosstalk reduction was observed. As the output of the gate driving circuit 102 is delayed by adjusting the timing of a gate output enable signal GOE output from the timing controller 101, the gate pulse can be delayed.

Figure 7:
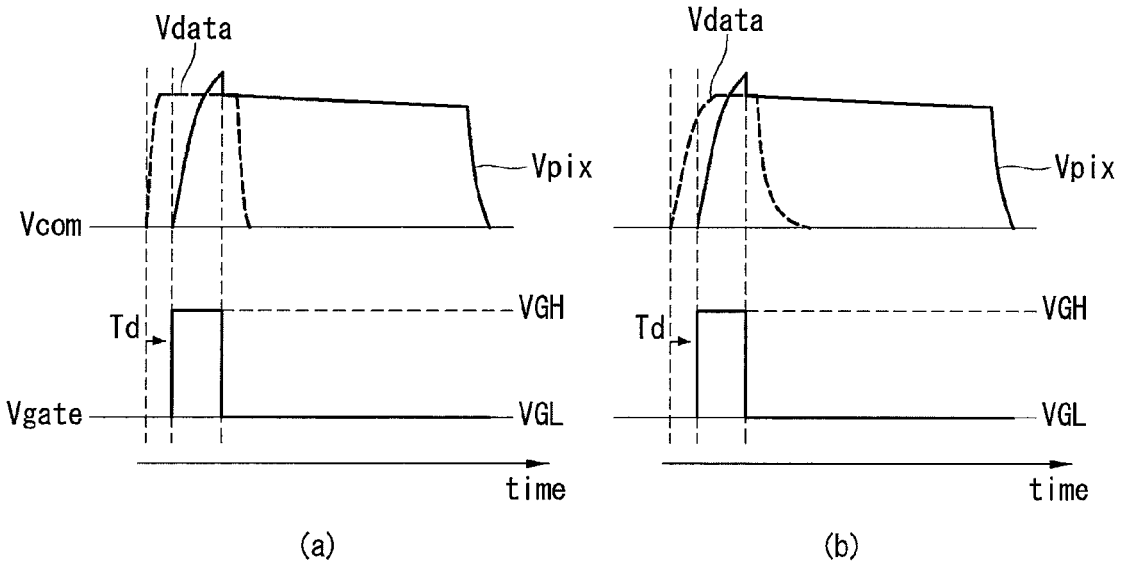
FIG. 7 is a waveform diagram showing a method of delaying a rising timing of a gate pulse according to another example embodiment of the invention.

FIGS. 5 through 7 are views showing a method of delaying the rising timing of a gate pulse according to an example embodiment of the invention.

Referring to FIGS. 5 through 7, in the method of delaying the rising timing of a gate pulse according to the example embodiment of the invention, the rising timing of a gate pulse Vgate is delayed to a point in time after the rising edge of data voltages Vdata in order for a difference in rising characteristic between the data voltages Vdata not to affect the pixel voltages of the pixels.

Similarly to FIG. 3, FIG. 5 also depicts waveform diagrams showing two examples in which a pixel voltage deviation occurs due to a difference in rising characteristics between data voltages, but FIG. 5 shows the waveform diagrams in the context of the gate-on timing delaying method. Thus, in (a) of FIG. 5, the rising characteristic of the data voltage (Vdata) is relatively rapid, while in (b) of FIG. 5, the rising characteristic of the data voltage (Vdata) is relatively less rapid, as shown by their relative slopes.

In the gate-on timing delaying method, only the rising timing of the gate pulse Vgate can be delayed as shown in FIG. 5. In this instance, the gate pulse Vgate have the same falling timing as in the conventional art but have a slower rising timing than the conventional one. Thus, the pulse width of the gate pulse Vgate can be reduced.

The gate-on timing delaying method shown in FIG. 5 may reduce the pixel voltage charging time of the pixels. As indicated by dotted lines in FIG. 6, a voltage difference between a high-gray level region and a low-gray level region is smaller than an intermediate gray level. Therefore, even if a pixel voltage becomes lower due to a gate pulse having a smaller pulse width as shown in FIG. 5, the viewer perceives little luminance difference in the high-gray level region and the low-gray level region. In the intermediate gray level, a luminance difference can be recognized even with a small difference in pixel voltage as shown in FIG. 6, and the gamma characteristic may be varied. Taking this into account, gamma tuning can be properly done by using the gate-on timing delaying method of FIG. 5. In FIG. 6, the horizontal axis V denotes a pixel voltage charged in the pixels, and the longitudinal axis T denotes the light transmittance of the pixels.

FIG. 5(*a*) depicts an example of delaying the gate pulse when data voltages whose gray level difference is small as shown in FIG. 3(*a*) are continuously supplied to the pixels of the Nth and (N+1)th lines through the same data line. FIG. 5(*b*) depicts an example of delaying the gate pulse when data voltages whose gray level difference is large as shown in FIG. 3(*b*) are continuously supplied to the pixels of the Nth and (N+1)th lines through the same data line. As can be seen from FIGS. 5(*a*) and 5(*b*), the amount of data voltages charged in the pixels of neighboring lines may be uniform even if the difference in gray level between continuous left-eye and right-eye images is large.

Using the gate-on timing delaying method, the rising and falling timings of the gate pulse Vgate can be both delayed, as shown in FIG. 7. In this instance, the pixel voltage charging rate and the pixel luminance are not lowered because the pulse width of the gate pulse Vgate is not reduced. Meanwhile, FIG. 7 also depicts waveform diagrams showing two examples in which a pixel voltage deviation occurs due to a difference in rising characteristics between data voltages. Thus, in (a) of FIG. 7, the rising characteristic of the data voltage (Vdata) is relatively rapid, while in (b) of FIG. 7, the rising characteristic of the data voltage (Vdata) is relatively less rapid, as shown by their relative slopes.

FIG. 7(*a*) depicts an example of delaying the gate pulse and increasing the pulse width when data voltages whose gray level difference is small as shown in FIG. 3(*a*) are continuously supplied to the pixels of the Nth and (N+1)th lines through the same data line. FIG. 7(*b*) depicts an example of delaying the gate pulse and increasing the pulse width when data voltages whose gray level difference is large as shown in FIG. 3(*b*) are continuously supplied to the pixels of the Nth and (N+1)th lines through the same data line.

FIGS. 8 through 11 are views showing a method of controlling a data voltage and a gate pulse.

Figure 8:
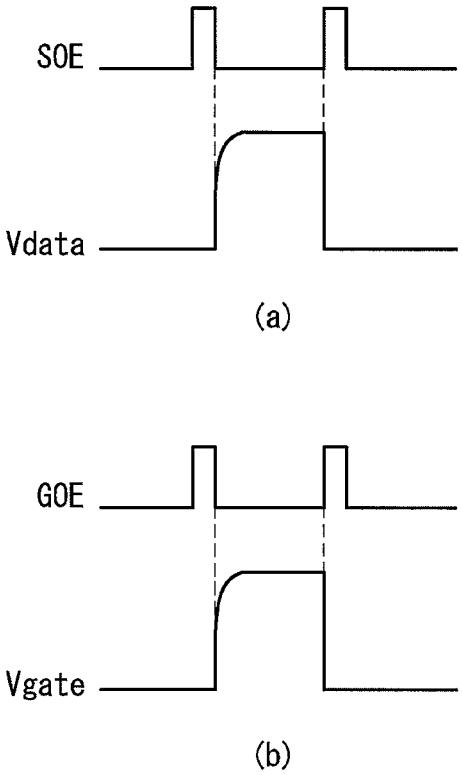
FIGS. 8 through 11 are waveform diagrams showing a method of controlling a data voltage and a gate pulse.

Referring to FIGS. 8 through 11, the data driving circuit 102 outputs a data voltage Vdata during a low logic period of the source output enable signal SOE (see (a) of FIG. 8). The gate driving circuit 103 outputs a gate pulse Vgate during the low logic period of the gate output enable signal GOE (see (b) of FIG. 8).

Figure 9:
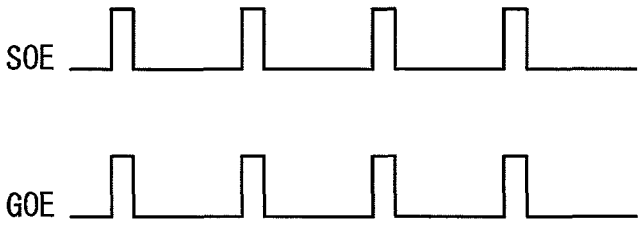
Figure 10:
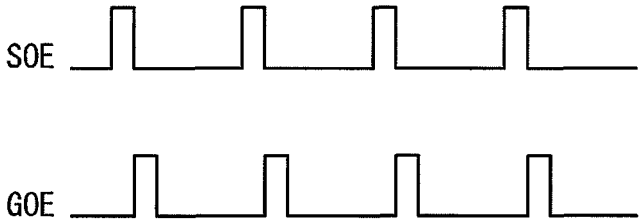
Figure 11:
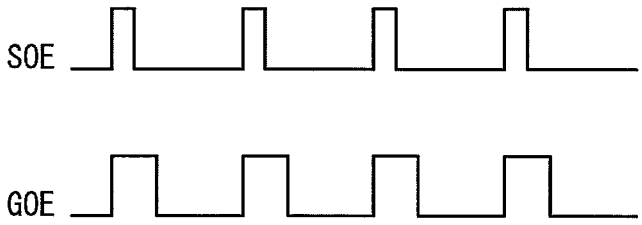

Assuming that the source output enable signal SOE and the gate output enable signal GOE are generated in the pattern shown in FIG. 9 in a conventional art or in the 2D mode, a delayed gate pulse Vgate can be realized as shown in FIG. 7 by delaying the gate output enable signal GOE by a predetermined time Td as shown in FIG. 10. A delayed gate pulse Vgate can be realized as shown in FIG. 5 by delaying the gate output enable signal GOE by a predetermined time Td as shown in FIG. 11 and increasing the pulse width of the gate output enable signal GOE to achieve a higher duty ratio.

Figure 12:
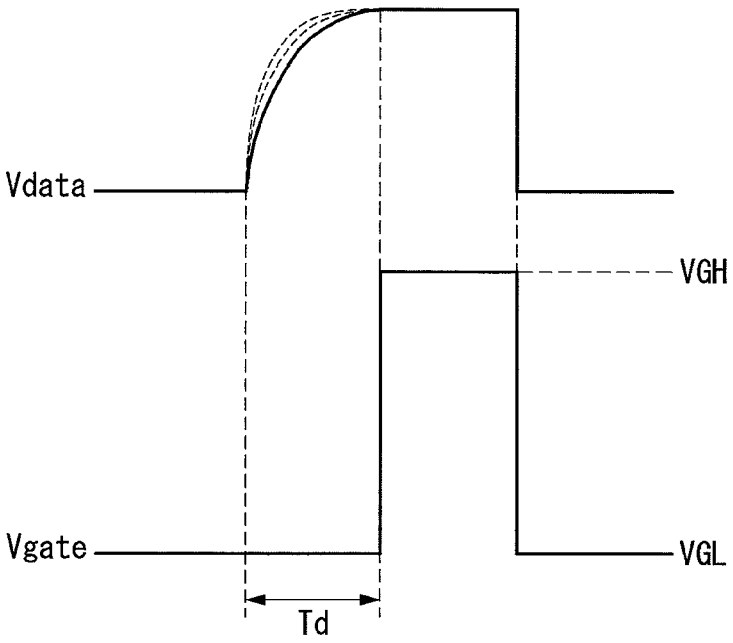
FIG. 12 is a view showing a method of setting a delay time of a rising timing of a gate pulse.

FIG. 12 is a view showing a method of setting the delay time of the rising timing of a gate pulse Vgate.

Referring to FIG. 12, the delay time Td of a gate pulse Vgate changes the gray levels of the first and second single-eye image data voltages consecutively supplied via the same data line, and the delay time Td of the rising timing of the gate pulse Vgate can be set based on the maximum rising edge time after measuring the rising edge time of the data voltages. For example, the delay time Td of the rising timing of the gate pulse Vgate can be set to an amount of time which is greater than the maximum rising edge time of the data voltages Vdata and less than half the pulse width of the gate pulse Vgate. The delay time of the rising timing of the gate pulse Vgate may be set to be substantially equal to the maximum rising edge time of the data voltages Vdata.

A liquid crystal display temporally and spatially inverts the polarity of a data voltage in order to prevent deterioration of liquid crystals and avoid afterimages and flickering. Most liquid crystal displays inverts the polarity of a data voltage charged in neighboring pixels in units of one dot or two dots, or inverts the polarity of a data voltage Vdata in units of one frame period by dot inversion. Each dot is a pixel or subpixel. The rising edge time of an (N+1)-th data voltage when the N-th and (N+1)-th data voltages have the same polarity is shorter than the rising edge time of the (N+1)-th data voltage when the N-th and (N+1)-th data voltages have different polarities. Accordingly, the rising timing of the gate pulse Vgate may be set to be greater than the maximum rising edge time of the data voltages Vdata that vary with changes in the polarity and gray level of the data voltages.

Figure 13:
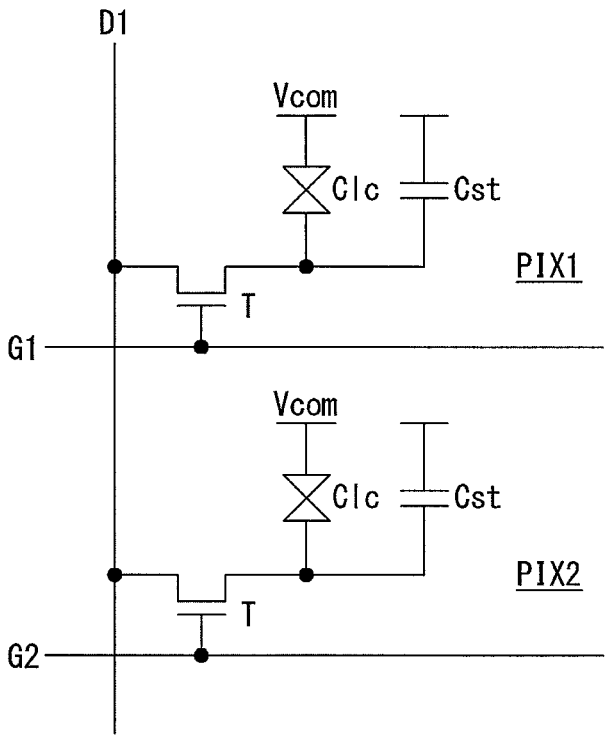
FIG. 13 is a circuit diagram showing two pixels connected to the same data line and vertically neighboring each other.
Figure 14:
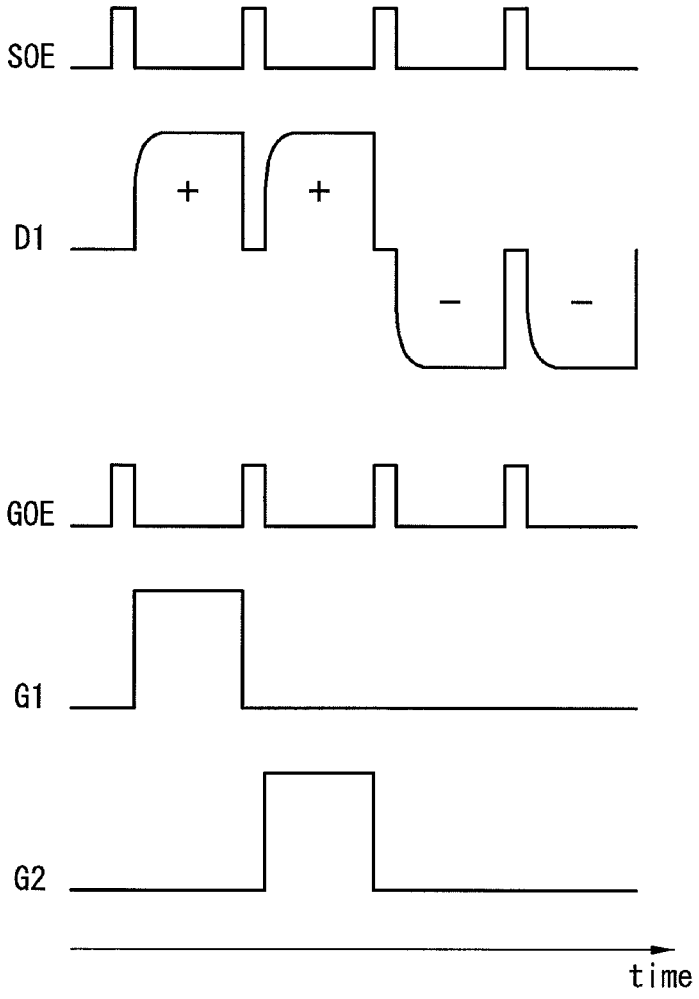
FIG. 14 is a view showing an example of a data voltage and a gate pulse which are applied to the same pixel as in FIG. 13.

FIG. 13 is a circuit diagram showing two pixels connected to the same data line and vertically neighboring each other. FIG. 14 is a view showing an example of a data voltage and a gate pulse applied to the same pixels. FIG. 14 illustrates an example in which the data voltage is inverted by a two dot inversion. By two dot inversion, the polarity of a data voltage is inverted every two horizontal periods. In FIGS. 13 and 14, D1 is a data line 106, and G1 and G2 are gate lines 107. In FIGS. 13 and 14, the polarity of the data voltage Vdata is inverted by the two dot inversion.

Figure 15:
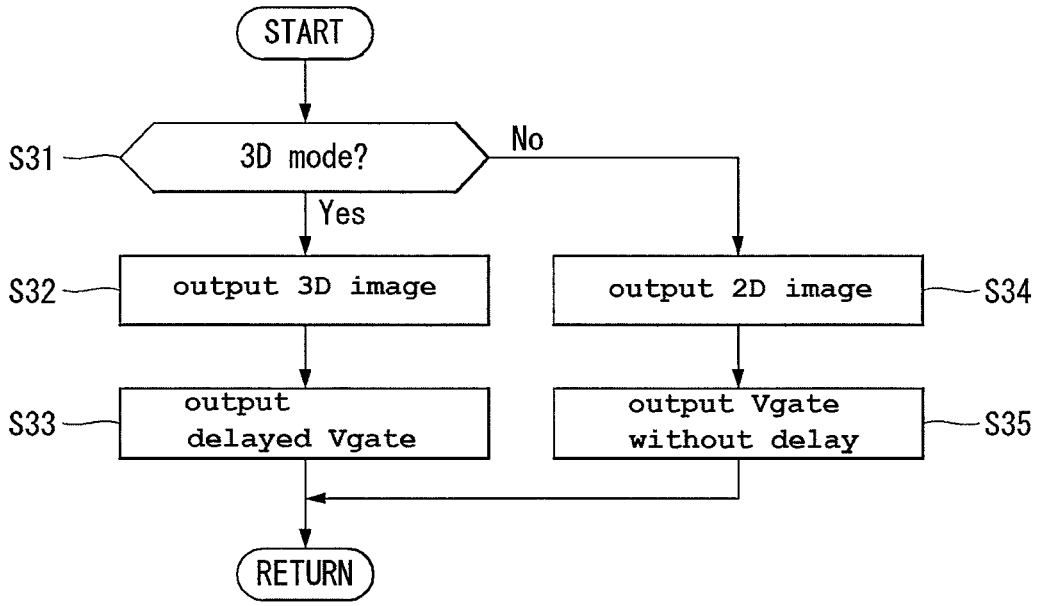
FIG. 15 is a flowchart showing a driving method of a stereoscopic image display according to an example embodiment of the invention.
Figure 16:
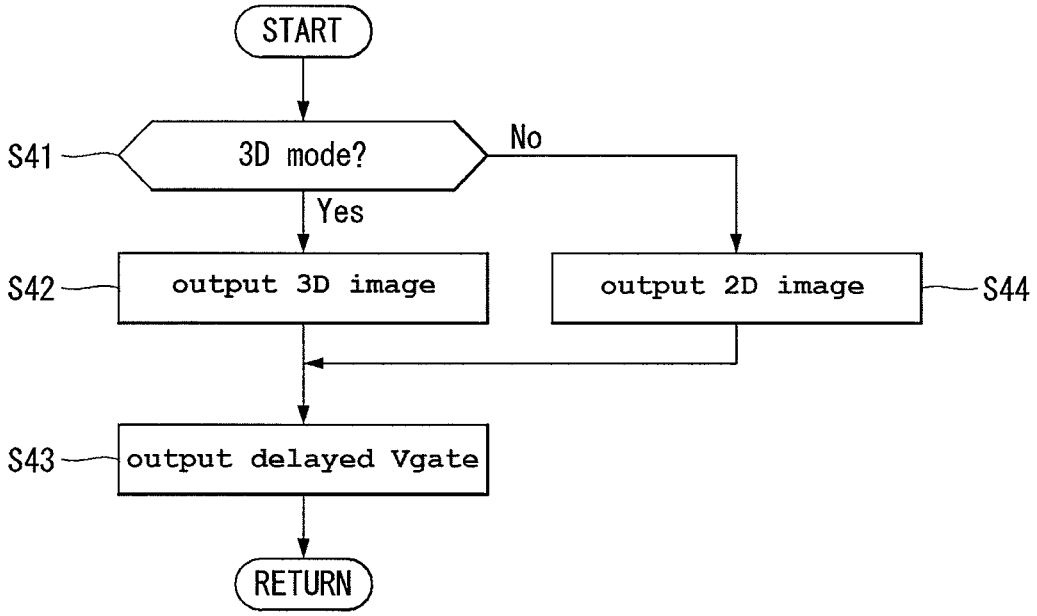
FIG. 16 is a flowchart showing a driving method of a stereoscopic image display according to another example embodiment of the invention.

FIGS. 15 and 16 show a driving method of a stereoscopic image display according to an example embodiment of the invention.

Referring to FIG. 15, the stereoscopic image display of the embodiment of the invention outputs the data voltage Vdata of a 3D image data to the data lines 106 of the display panel PNL in the 3D mode (S31 and S32), and outputs a gate pulse Vgate delayed by a predetermined time Td to the gate lines 107 (S33). The gate pulse Vgate may be delayed in the same pattern as in FIG. 5 or FIG. 7.

The stereoscopic image display of the embodiment of the invention outputs the data voltage Vdata of a 2D image having no binocular parallax to the data lines 106 of the display panel PNL in the 2D mode, and outputs a gate pulse Vgate to the gate lines 107 without a delay (S34 and S35).

In the driving method of the stereoscopic image display shown in FIG. 15, the rising timing of the gate pulse Vgate applied to the same gate line 107 is different in the 2D mode and the 3D mode. Specifically, the rising timing of a gate pulse generated in the 3D mode is slower than that of a gate pulse generated in the 2D mode.

Referring to FIG. 16, the stereoscopic image display of the embodiment of the invention outputs the data voltage Vdata of a 3D image to the data lines 106 of the display panel PNL in the 3D mode (S41 and S42), and outputs a gate pulse Vgate delayed by a predetermined time Td to the gate lines 107 (S43).

The stereoscopic image display of the embodiment of the invention outputs the data voltage Vdata of a 2D image having no binocular parallax to the data lines 106 of the display panel PNL in the 2D mode, and outputs a gate pulse Vgate to the gate lines 107 without delay (S44). In the 2D and 3D modes, the gate pulse Vgate may be delayed in the same pattern as in FIG. 5 or FIG. 7.

In the driving method of the stereoscopic image display shown in FIG. 16, the rising timing of a gate pulse Vgate applied to the same gate line is substantially the same in the 2D mode and the 3D mode.

As described above, gray-to-gray (GTG) crosstalk in a stereoscopic image can be minimized by delaying the rising timing of the gate pulse to a point in time after the rising edge time of the data voltage. As a result, the embodiment of the invention can improve the display quality of a stereoscopic image that the viewer feels or perceives under an actual viewing environment.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A stereoscopic image display comprising:

a data driving circuit that supplies a data voltage to data lines of a display panel;

a gate driving circuit that supplies a gate pulse to gate lines of the display panel; and a timing controller that controls operation timings of the data driving circuit and gate driving circuit, wherein the gate driving circuit delays a rising timing of the gate pulse to a point in time after a rising edge time of the data voltage in a 3D mode for displaying a 3D image on the display panel, under a control of the timing controller, and wherein a delay time of the rising timing of the gate pulse is set to be substantially equal to a maximum rising edge time of the data voltage.

2. The stereoscopic image display of claim 1, further comprising a film patterned retarder attached onto the display panel.

3. The stereoscopic image display of claim 2, wherein the film patterned retarder includes first phase delay patterns corresponding to odd-numbered lines of the display panel and second phase delay patterns corresponding to even-numbered lines of the display panel, and the odd-numbered lines display a left-eye image and the even-numbered lines display a right-eye image.

4. The stereoscopic image display of claim 1, wherein the timing controller generates a gate output enable signal for controlling an output timing of the gate driving circuit, and in a 2D mode for displaying a 2D image on the display panel, controls the rising timing of the gate pulse to be faster than in the 3D mode by using the gate output enable signal.

5. The stereoscopic image display of claim 1, wherein the timing controller generates a gate output enable signal for controlling an output timing of the gate driving circuit, and in a 2D mode for displaying a 2D image on the display panel, controls the rising timing of the gate pulse to be equal to that in the 3D mode by using the gate output enable signal.

6. The stereoscopic image display of claim 4, wherein the timing controller controls a pulse width of the gate pulse generated in the 2D mode to be greater than a pulse width of the gate pulse generated in the 3D mode by using the gate output enable signal.

7. The stereoscopic image display of claim 5, wherein the timing controller controls a pulse width of the gate pulse generated in the 2D mode to be greater than a pulse width of the gate pulse generated in the 3D mode by using the gate output enable signal.

8. The stereoscopic image display of claim 4, wherein the timing controller controls a pulse width of the gate pulse generated in the 2D mode to be equal to a pulse width of the gate pulse generated in the 3D mode by using the gate output enable signal.

9. The stereoscopic image display of claim 5, wherein the timing controller controls a pulse width of the gate pulse generated in the 2D mode to be equal to a pulse width of the gate pulse generated in the 3D mode by using the gate output enable signal.

10. A driving method of a stereoscopic image display, the method comprising:

supplying a data voltage to data lines of a display panel; and supplying a gate pulse to gate lines of the display panel, wherein a rising timing of the gate pulse is delayed to a point in time after a rising edge time of the data voltage in a 3D mode for displaying a 3D image on the display panel, and wherein a delay time of the rising timing of the gate pulse is set to be substantially equal to a maximum rising edge time of the data voltage.

11. The method of claim 10, wherein, in a 2D mode for displaying a 2D image on the display panel, the rising timing of the gate pulse is controlled to be faster than in the 3D mode.

12. The method of claim 10, wherein, in a 2D mode for displaying a 2D image on the display panel, the rising timing of the gate pulse is controlled be equal to that in the 3D mode.

13. The method of claim 10, wherein a pulse width of the gate pulse is generated in a 2D mode to be greater than a pulse width of the gate pulse generated in the 3D mode.

14. The method of claim 10, wherein a pulse width of the gate pulse is generated in a 2D mode to be equal to a pulse width of the gate pulse generated in the 3D mode.

15. The method of claim 10, wherein the gate pulse is delayed by delaying a gate output enable signal by a predetermined time Td relative to a source output enable signal.

16. A driving method of a stereoscopic image display, the method comprising:

supplying a data voltage to data lines of a display panel; and supplying a gate pulse to gate lines of the display panel at different times depending on selection of a 2D mode for displaying a 2D image on the display panel or a 3D mode for displaying a 3D image on the display panel, wherein a rising timing of the gate pulse is delayed, and a delay time of the rising timing of the gate pulse is set to be substantially equal to a maximum rising edge time of the data voltage.

17. The method of claim 16, wherein the supply of the gate pulse is delayed in the 3D mode compared to the 2D mode.

18. The method of claim 16, wherein a pulse width of the gate pulse is generated in the 2D mode to be greater than a pulse width of the gate pulse generated in the 3D mode.

19. The method of claim 16, wherein a pulse width of the gate pulse is generated in the 2D mode to be equal to a pulse width of the gate pulse generated in the 3D mode.

* * * * *